US009183809B2

(12) United States Patent
Jeong et al.

(10) Patent No.: US 9,183,809 B2
(45) Date of Patent: Nov. 10, 2015

(54) METHOD OF DRIVING DISPLAY PANEL AND DISPLAY APPARATUS FOR PERFORMING THE SAME

(71) Applicant: SAMSUNG DISPLAY CO., LTD., Gyeonggi-Do (KR)

(72) Inventors: Jae-Won Jeong, Seoul (KR); Woo-Jin Jung, Seoul (KR); Kang-Hyun Kim, Seoul (KR); Po-Yun Park, Seoul (KR); Kwan-Young Oh, Seoul (KR); Jee-Hoon Jeon, Gyeonggi-do (KR); Youn-Jin Jung, Daejeon (KR); Young-Suk Ha, Gyeonggi-do (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 164 days.

(21) Appl. No.: 13/732,865

(22) Filed: Jan. 2, 2013

(65) Prior Publication Data

US 2013/0169619 A1 Jul. 4, 2013

(30) Foreign Application Priority Data

Jan. 3, 2012 (KR) ..... 10-2012-0000740

(51) Int. Cl.
*G09G 5/00* (2006.01)
*G09G 3/36* (2006.01)

(52) U.S. Cl.
CPC ..... *G09G 5/001* (2013.01); *G09G 3/3696* (2013.01); *G09G 3/3607* (2013.01); *G09G 2300/0426* (2013.01); *G09G 2310/0251* (2013.01); *G09G 2320/0209* (2013.01); *G09G 2320/0242* (2013.01)

(58) Field of Classification Search
None
See application file for complete search history.

(56) References Cited

U.S. PATENT DOCUMENTS

| | | | | |
|---|---|---|---|---|
| 7,298,379 | B2 | 11/2007 | Xu et al. | |
| 7,450,098 | B2 | 11/2008 | Lee et al. | |
| 2006/0114270 | A1 | 6/2006 | Shih et al. | |
| 2009/0066627 | A1 * | 3/2009 | Yin | 345/94 |
| 2009/0295703 | A1 * | 12/2009 | Hsieh et al. | 345/94 |
| 2011/0080440 | A1 * | 4/2011 | Cheon | 345/691 |
| 2011/0221727 | A1 * | 9/2011 | Kim et al. | 345/209 |

FOREIGN PATENT DOCUMENTS

| | | |
|---|---|---|
| JP | 2006-349873 | 12/2006 |
| JP | 2010-231757 | 10/2010 |
| KR | 1020090099836 | 9/2009 |
| KR | 1020110130126 | 12/2011 |

* cited by examiner

*Primary Examiner* — Joseph Haley
*Assistant Examiner* — Emily Frank
(74) *Attorney, Agent, or Firm* — F. Chau & Associates, LLC

(57) ABSTRACT

A display panel apparatus includes a display panel and a timing controller, and a data driver. The display panel includes a first subpixel and a second subpixel. The timing controller is configured to receive a first subpixel data for the first subpixel and a second subpixel data for the second subpixel. When the second subpixel is determined to be defective, the timing controller generates a compensated grayscale of the second subpixel data. The data driver is configured to apply a precharge voltage to the second subpixel and a charging voltage to second subpixel through a data line, wherein the precharge voltage is based on a grayscale of the first subpixel data and the charging voltage is based on the compensated grayscale of the second subpixel data.

25 Claims, 12 Drawing Sheets

METHOD OF DRIVING DISPLAY PANEL AND DISPLAY APPARATUS FOR PERFORMING THE SAME

CROSS-REFERENCE TO RELATED APPLICATION

This application claims priority under 35 U.S.C. §119 to Korean Patent Application No. 10-2012-0000740, filed on Jan. 3, 2012, in the Korean Intellectual Property Office, the disclosure of which is incorporated by reference herein in its entirety.

TECHNICAL FIELD

The present inventive concept relates to a method of driving a display panel and a display apparatus performing the method.

DISCUSSION OF RELATED ART

Recently, the higher resolution of liquid crystal display apparatuses ("LCDs") may reduce a charging duration of the subpixel because the number of horizontal rows increases. A precharge driving method is generally used to secure a charging duration necessary to display an image. In a precharge driving method, a precharge voltage is charged to the subpixel before a data voltage is charged to the subpixel. Thus, though the charging duration is short, the data voltage may be sufficiently charged to the subpixel.

However, the precharge driving method may result in a display defect when a precharge voltage is very low compared to a target charging voltage. Accordingly, a difference of luminance between subpixels may occur in a horizontal direction or a vertical direction due to the difference between a precharge voltage and a charging voltage. Thus, a horizontal spot line or a vertical spot line may appear on a display panel.

BRIEF SUMMARY OF THE INVENTION

According to an embodiment of the inventive concept, a first subpixel data is received for a first subpixel. A second subpixel data is received for a second subpixel. A precharge voltage is applied to the second subpixel based on a grayscale of the first subpixel data through a data line. It is determined whether the second subpixel has a displaying defect based on the grayscale of the first subpixel data and a grayscale of the second subpixel data. A compensated grayscale of the second subpixel data is generated when the second subpixel is determined to be defective. A charging voltage based on the compensated grayscale of the second subpixel data is applied to the second subpixel through the data line.

According to an embodiment, a display panel apparatus includes a display panel and a timing controller, and a data driver. The display panel includes a first subpixel and a second subpixel. The timing controller is configured to receive a first subpixel data for the first subpixel and a second subpixel data for the second subpixel. When the second subpixel is determined to be defective, the timing controller generates a compensated grayscale of the second subpixel data. The data driver is configured to apply a precharge voltage to the second subpixel and a charging voltage to second subpixel through a data line, wherein the precharge voltage is based on a grayscale of the first subpixel data and the charging voltage is based on the compensated grayscale of the second subpixel data. Exemplary embodiments of the present invention provide a method of driving a display panel to improve a display quality.

BRIEF DESCRIPTION OF THE DRAWINGS

These and other features of the inventive concept will become apparent by describing in detail exemplary embodiments thereof with reference to the accompanying drawings of which.

DETAILED DESCRIPTION OF THE INVENTION

Figure 1:
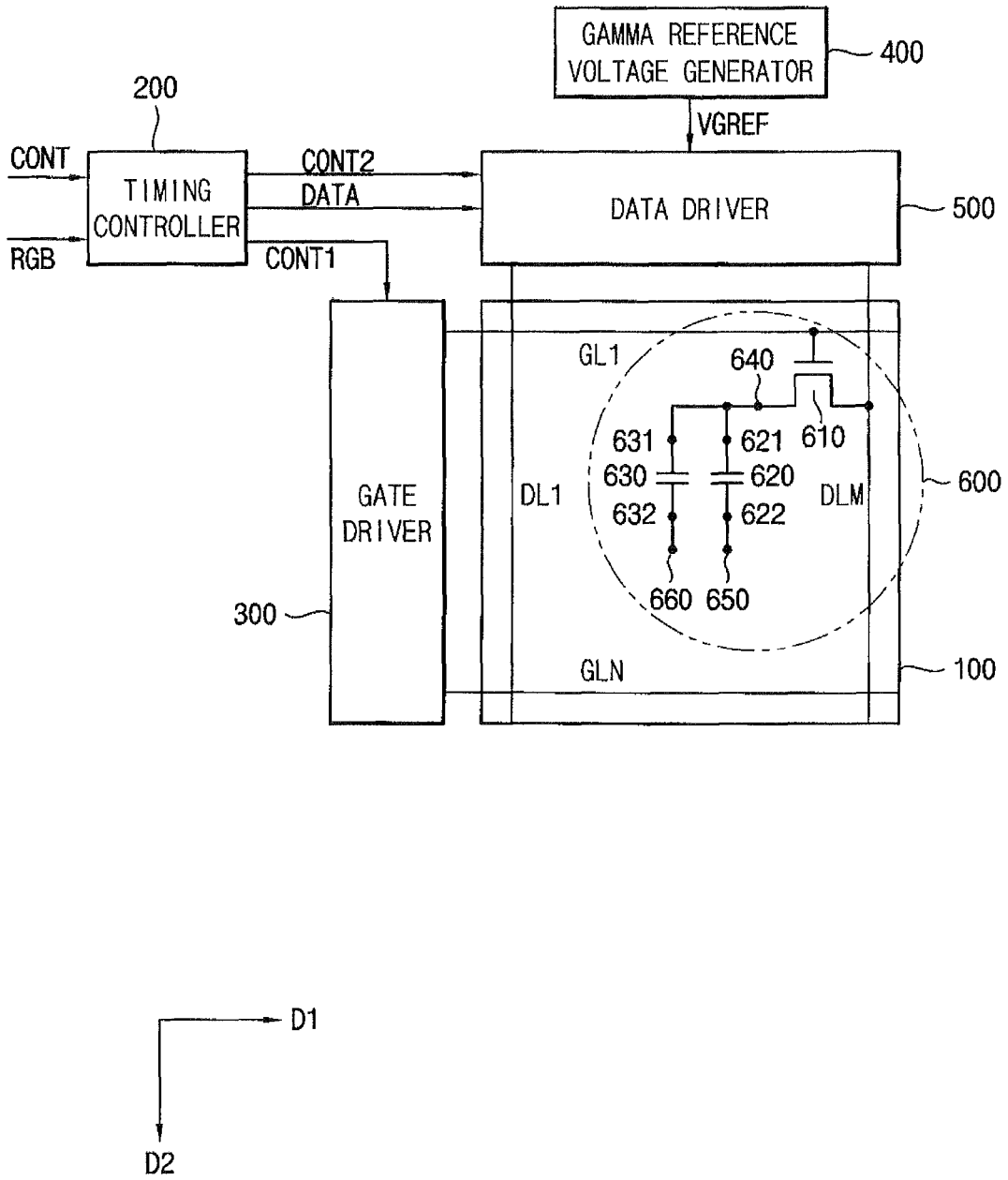
FIG. 1 is a block diagram of a display apparatus according to an exemplary embodiment of the present invention.

Exemplary embodiments of the inventive concept will be described below in more detail with reference to the accompanying drawings. However, the inventive concept may be embodied in different forms and should not be construed as limited to the embodiments set forth herein. Rather, these exemplary embodiments are provided so that this disclosure will be thorough and complete and will fully convey the inventive concept to those skilled in the art. Like reference numerals may refer to the like elements throughout the specification and drawings FIG. 1 is a block diagram of a display apparatus according to an exemplary embodiment of the present invention.

Referring to FIG. 1, the display apparatus includes a display panel 100, a timing controller 200, a gate driver 300, a gamma reference voltage generator 400 and a data driver 500.

The display panel 100 includes a plurality of gate lines GL1 to GLN, a plurality of data lines DL1 to DLM and a plurality of subpixels connected to the gate lines GL1 to GLN and the data lines DL1 to DLM.

The gate lines GL1 to GLN extend in a first direction D1, and the data lines DL1 to DLM extend in a second direction D2 perpendicular to the first direction D1. A subpixel 600 includes a switching element 610, a liquid crystal capacitor 620 and a storage capacitor 630. The liquid crystal capacitor 620 and the storage capacitor 630 are electrically connected to the switching element 610. The subpixels are arranged in a matrix form. The switching element 610 may be a thin film transistor.

The liquid crystal capacitor 620 includes a first electrode 621 connected to a pixel electrode 640 and a second electrode 622 connected to a common electrode 650. A precharge or charging voltage is applied to the first electrode 621 of the liquid crystal capacitor 620. A common voltage 650 is applied to the second electrode 622 of the liquid crystal capacitor 620. The storage capacitor 630 includes a first electrode 631 connected to the pixel electrode 640 and a second electrode 632 connected to a storage electrode 660. A data voltage is applied to the first electrode 631 of the storage capacitor 630. A storage voltage is applied to the second electrode 632 of the storage capacitor 630. The storage voltage may be substantially equal to the common voltage.

The subpixel 600 may have a rectangular shape. The subpixel 600 may have a relatively short side in the first direction D1 and a relatively long side in the second direction D2. The relatively long side of the subpixel may be substantially parallel to the data lines DL1 to DLM.

An arrangement of gate lines, data lines, and subpixels of the display panel 100 will be explained referring to FIG. 2 in detail.

The timing controller 200 receives a subpixel data RGB and an input control signal CONT and generates a first control signal CONT1, a second control signal CONT2 and a compensated subpixel data DATA. The subpixel data RGB includes a grayscale of a red subpixel data R, a grayscale of a green subpixel G and/or a grayscale of a blue subpixel data B. The input control signal CONT may include a master clock signal, a data enable signal, a vertical synchronizing signal and/or a horizontal synchronizing signal.

The first control signal CONT1 is outputted to the gate driver 300 and controls a driving timing of the gate driver 300. The first control signal CONT1 may include a vertical start signal and a gate clock signal.

The second control signal CONT2 is outputted to the data driver 500 and controls a driving timing of the data driver 500. The second control signal CONT2 may include a horizontal start signal and a load signal.

The compensated subpixel data DATA may have the same grayscale of the subpixels R, G, and B or may have a compensated grayscale from that of the subpixel data. The compensated grayscale data DATA is outputted to the data driver 500. The compensated subpixel data DAT will be explained in detail referring to FIGS. 7 and 9 through 12.

Figure 7:
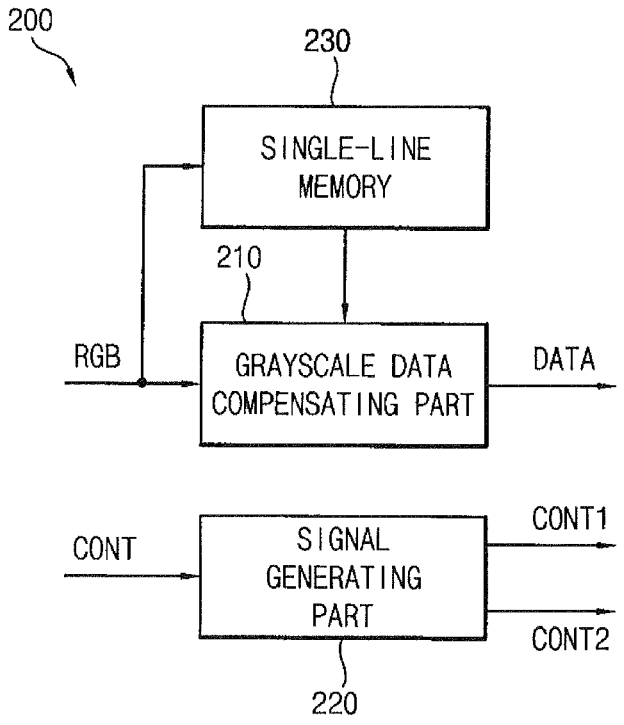
FIG. 7 is a block diagram of the timing controller 200 of FIG. 1 according to an exemplary embodiment of the inventive concept.

According to an exemplary embodiment of the inventive concept, the timing controller 200 may include a grayscale compensating part 210 and a signal generating part 220 as shown in FIG. 7. An operation of the timing controller 200 including the grayscale compensating part 210 and the signal generating part 220 will be explained in detail referring to FIG. 7.

The gate driver 300 receives the first control signal CONT1 from the timing controller 200. The gate driver 300 generates gate signals for driving the gate lines GL1 to GLN in response to the first control signal CONT1. The gate driver 300 sequentially outputs the gate signals to the gate lines GL1 to GLN.

The gate driver 300 may be disposed, e.g., directly mounted, on the display panel 100, or may be connected to the display panel 100 in a tape carrier package ("TCP") type. Alternatively, the gate driver 500 may be integrated on the display panel 100.

The gamma reference voltage generator 400 generates a gamma reference voltage VGREF. The gamma reference voltage generator 400 provides the gamma reference voltage VGREF to the data driver 500. The gamma reference voltage VGREF has values corresponding to the grayscale of the compensated subpixel data DATA.

For example, the gamma reference voltage generator 400 includes a resistor string circuit having a plurality of resistors connected in series connected between a source voltage and a ground voltage, generating the gamma reference voltage VGREF by dividing the source voltage based on the grayscale of the compensated subpixel data DATA. The gamma reference voltage generator 400 outputs the gamma reference voltage VGREF to the data driver 500. According to an exemplary embodiment, the gamma reference voltage generator 400 may be disposed in the data driver 500.

The data driver 500 receives the second control signal CONT2 and the compensated subpixel data DATA from the timing controller 200. The data driver 500 receives the gamma reference voltage VGREF from the gamma reference voltage generator 400.

The data driver 500 converts the compensated subpixel data DATA to an analog signal having a voltage corresponding to the grayscale of the compensated subpixel data DATA. The gamma reference voltage VGREF is used as a reference signal to such digital-to-analog conversion. The data driver 500 sequentially outputs the analog signal to the data lines DL1 to DLM according to the second control signal CONT2.

The data driver 500 may include a shift register (not shown), a latch (not shown), a signal processor (not shown) and a buffer (not shown). The shift register outputs a latch pulse to the latch. The latch temporarily stores the compensated subpixel data DATA, and outputs the compensated subpixel data DATA to the signal processor. The signal processor generates the analog signal based on the grayscale of the compensated subpixel data DATA of digital signal and the gamma reference voltage VGREF, and outputs the analog signal to the buffer. The buffer outputs the analog signal to the data lines DL1 to DLM. Hereinafter, the analog signal may be interchangeably used with a data voltage.

The data driver 500 may be disposed, e.g., directly mounted, on the display panel 100, or be connected to the display panel 100 in a TCP type. Alternatively, the data driver 500 may be integrated on the display panel 100.

Figure 2:
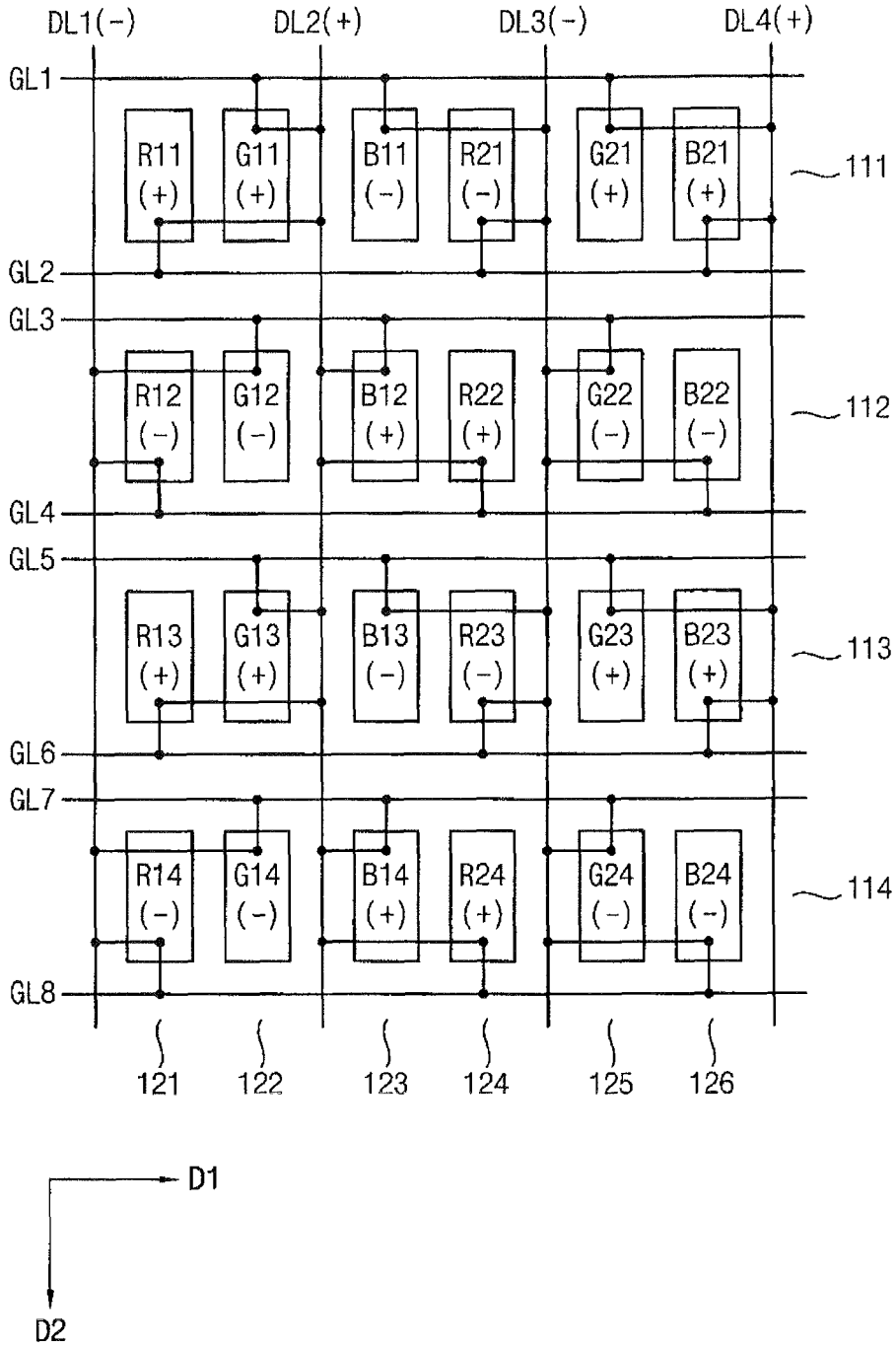
FIG. 2 shows an arrangement of data lines, gate lines and subpixels of the display panel 100 of FIG. 1 according to an exemplary embodiment of the inventive concept.

FIG. 2 shows an arrangement of data lines, gate lines and subpixels of the display panel 100 of FIG. 1 according to an exemplary embodiment of the inventive concept. For simplicity of explanation, the display panel 100 includes two by four pixels, i.e., eight pixels. In order to drive those eight pixels, the display panel 100 includes four data lines and eight gate lines.

Figure 8:
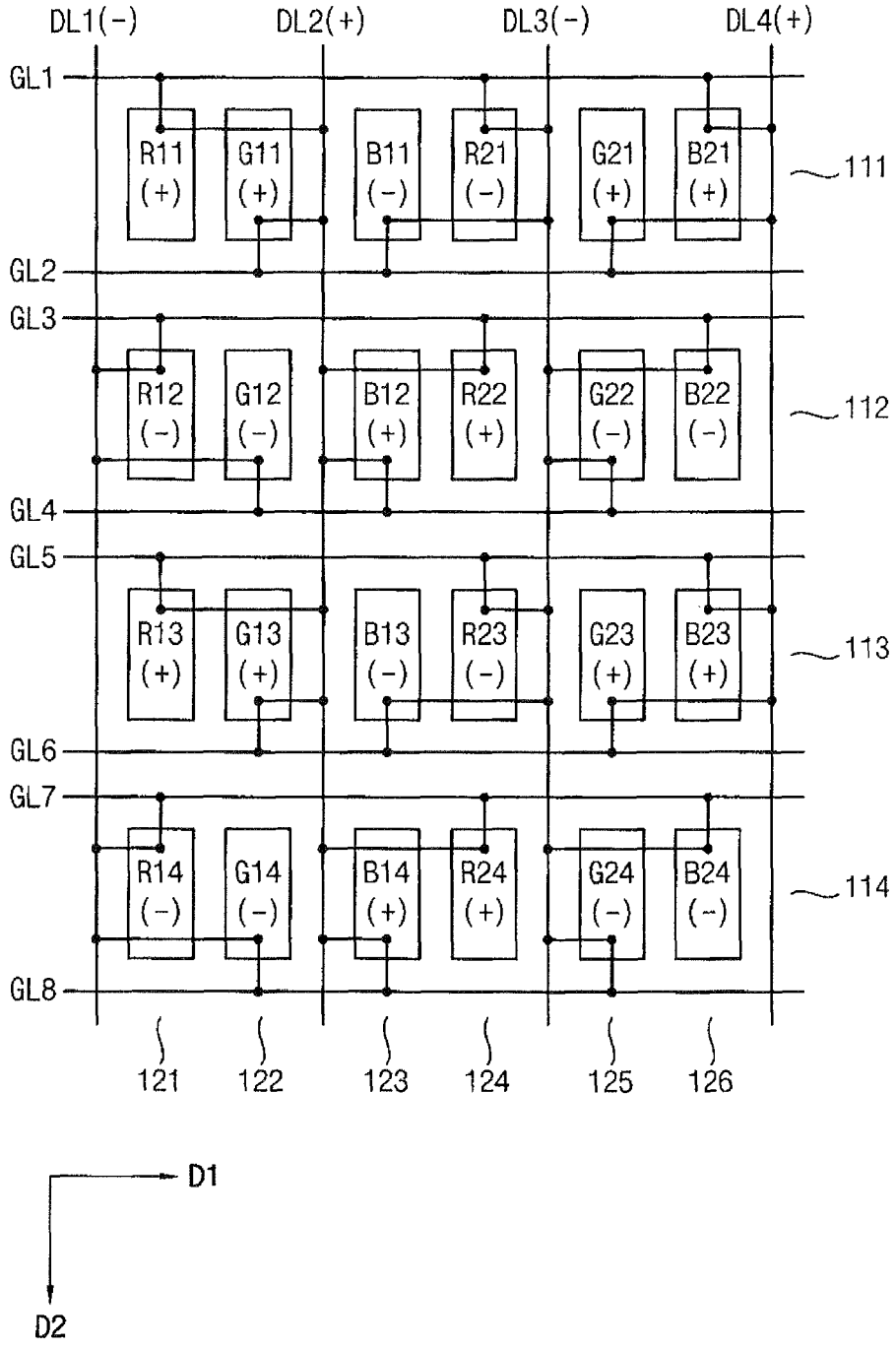
FIG. 8 shows an arrangement of data lines, gate lines and subpixels of the display panel 100 of FIG. 1 according to an exemplary embodiment of the inventive concept.

The arrangement may be configured in various ways according to an exemplary embodiment. For example, FIG. 8 shows an arrangement of gate lines, data lines, and subpixels of the display panel 100. Hereinafter, the operation of a display apparatuses according to an exemplary embodiment will be explained using the arrangement of FIG. 2. The same operation applies to the arrangement of FIG. 8, so for brevity of explanation, further explanation about FIG. 8 will be omitted.

Referring to FIGS. 1 and 2, the display panel 100 includes a plurality of pixels. Each of pixels includes a red subpixel, a green subpixel and a blue subpixel. For example, three subpixels R11, G11, and B11 positioned at the upper left-hand corner may constitute a first pixel. Subpixels whose name includes "R" represent red subpixels. Subpixels whose name includes "G" represent green subpixels. Subpixels whose name includes "B" represent blue subpixels. The eight pixels include twenty four subpixels such as plurality of subpixels R11 to R14, G11 to G14, B11 to B14, R21 to R24, G21 to G24 and B21 to B24. Those subpixels are disposed in a matrix form. Each subpixel is electrically connected to the gate line GL1 to GL8 and the data line DL1 to DL4.

The subpixels R11 to B24 are arranged in first to sixth subpixel columns 121 to 126. Red subpixels R11 to R14 and R21 to R24 constitute first and fourth subpixel columns 121 and 124. Green subpixels G11 to G14 and G21 to G24 constitute second and fifth subpixel columns 122 and 125. Blue subpixels B11 to B14 and B21 to B24 constitute third and sixth subpixel columns 123 and 126.

The subpixels R11 to B24 are arranged in first to fourth subpixel rows 111 to 114. According to an exemplary embodiment of the inventive concept, each subpixel row is eclectically connected by two gate lines. For example, the first subpixel row 111 is electrically connected by two gate lines GL1 and GL2. The second subpixel row 112 is electrically connected by two gate lines GL3 and GL4. The third subpixel row 112 is electrically connected by two gate lines GL5 and GL6. The fourth subpixel row 112 is electrically connected by two gate lines GL7 and GL8.

In the first subpixel row 111, the first gate line GL1 is electrically connected to half of the first subpixel row 111 such as G11, B11, and G21, and the second gate line GL2 is electrically connected to the other subpixels of the first subpixel row 111 such as R11, R21 and B21. As to the second subpixel row 112, the third gate line GL3 is electrically connected to half of the second subpixel row 112 such as G12, B12, and G22, and the fourth gate line GL4 is electrically connected to the other subpixels of the second subpixel row 112 such as R12, R22 and B22. The third subpixel row 113 and the fourth subpixel row 114 are also arranged in a similar way as explained above.

Hereinafter, the arrangement of data lines DL1 to DL4 will be explained. According to an exemplary embodiment of the inventive concept, two adjacent subpixel columns are electrically connected to two adjacent data lines. For example, a first two adjacent subpixel columns 121 and 122 are electrically connected to two adjacent data lines DL1 and DL2. A second two adjacent subpixel columns 123 and 124 are electrically connected to two adjacent data lines DL3 and DL4. A third two adjacent subpixel columns 125 and 126 are electrically connected to two adjacent data line s DL5 and DL6.

In the first two adjacent subpixel columns 121 and 122, two subpixels are alternately connected to data lines DL1 and DL2. For example, two subpixels R11 and G11 of the first subpixel row 111 are connected to the second data line DL2. Two subpixels R12 and G12 of the second subpixel row 112 are connected to the first data line DL1. Two subpixels R13 and G13 of the third subpixel row 113 are connected to the second data line DL2. Two subpixels R14 and G14 of the fourth subpixel row 114 are connected to the first data line DL1.

In a similarly way as explained above, the second two adjacent subpixel columns 123 and 124 are alternately connected to two data lines DL2 and DL3. The third two adjacent subpixel columns 125 and 126 are alternately connected to two data lines DL3 and DL4. As shown explained above, the second data line DL2 is shared between the first two adjacent subpixel columns 121 and 122 and the second two adjacent subpixel columns 123 and 124. The third data line DL3 is shared between the second two adjacent subpixel columns 123 and 124 and the third two adjacent subpixel columns 125 and 126.

Subpixels R11 to R14 of the first subpixel column 121 are connected to one of the first data line DL1 and the second data line DL2. For example, connected to the first data line DL1 are a second subpixel R12 and a fourth subpixel R14 of the first subpixel column 121. A first subpixel R11 and a third subpixel R13 of the first subpixel column 121 are connected to the second data line DL2.

Subpixels G11 to G14 of the second subpixel column are connected to one of the first data line DL1 and the second data line DL2. For example, connected to the first data line DL1 are a second subpixel G12 and a fourth subpixel G14 of the second subpixel column. A first subpixel G11 and a third subpixel G13 of the second subpixel column are connected to the second data line DL2.

The data line DL1 and DL4 may have half connections compared to those of data lines DL2 and DL3 located inside. For example, the data line DL1 has no subpixels at its left side, so the data line DL1 is connected to two subpixels at its right side due to such alternate connection, e.g., two subpixels R12 and G12 of the second subpixel row 112 and two subpixels R14 and G14 of the fourth subpixel row 114. The data line DL4 has no subpixels at its right side, so the data line DL4 is connected to two subpixels at its left side due to such alternate connection, e.g., two subpixels G21 and B21 of the first subpixel row 111 and two subpixels G23 and B23 of the third subpixel row 113.

The second data line DL2 is sequentially connected to a first subpixel G11 of the second subpixel column 122, a first subpixel R11 of the first subpixel column 121, a second subpixel B12 of the third subpixel column 113, a second subpixel R22 of the fourth subpixel column 124, a third subpixel G13 of the second subpixel column 112, a third subpixel R13 of the first subpixel column 121, a fourth subpixel B14 of the third subpixel column 123 and a fourth subpixel R24 of the fourth subpixel column 124.

Data voltages or analog signals are applied to data lines DL1 to DL4 in a frame. The polarities of the data voltages are inverted in the next frame.

For example, during a first frame, data voltages having a negative polarity (−) are applied to the first data line DL1, data voltages having a positive polarity (+) are applied to the second data line DL2, data voltages having the negative polarity (−) are applied to the third data line DL3 and data voltages having the positive polarity (+) are applied to the fourth data line DL4.

Accordingly, the display panel 100 may have a polarity pattern to the effect of a dot inversion according to the arrangement of the gate lines and the data lines according to an exemplary embodiment of the inventive concept. For example, the first subpixel row 111 may have a polarity pattern of "+, +, −, +"; the second subpixel row 112 may have an inverted polarity pattern of "−, +, +, −"; the third subpixel row 113 may have the same polarity pattern as that of the first subpixel row 111; and the fourth subpixel row 114 may have the same polarity pattern as that of the second subpixel row 112. Therefore, the display panel 100 may have a polarity pattern of a dot inversion where two subpixels have the same polarity with each other and are surrounded by subpixels having the opposite polarity.

In the next frame, data voltages having the positive polarity (+) are applied to the first data line DL1, data voltages having the negative polarity (−) are applied to the second data line DL2, data voltages having the positive polarity (+) are applied to the third data line DL3 and data voltages having the negative polarity (−) are applied to the fourth data line DL4. As explained above, the display panel 100 may have a polarity pattern of a dot inversion.

As a result, the display panel 100 may have a dot inversion effect, that is, every two subpixels are inverted in the first direction D1 and every subpixel is inverted in the second direction D2 by a column inversion method which provides data voltages having opposite polarities to adjacent data lines.

Figure 3:
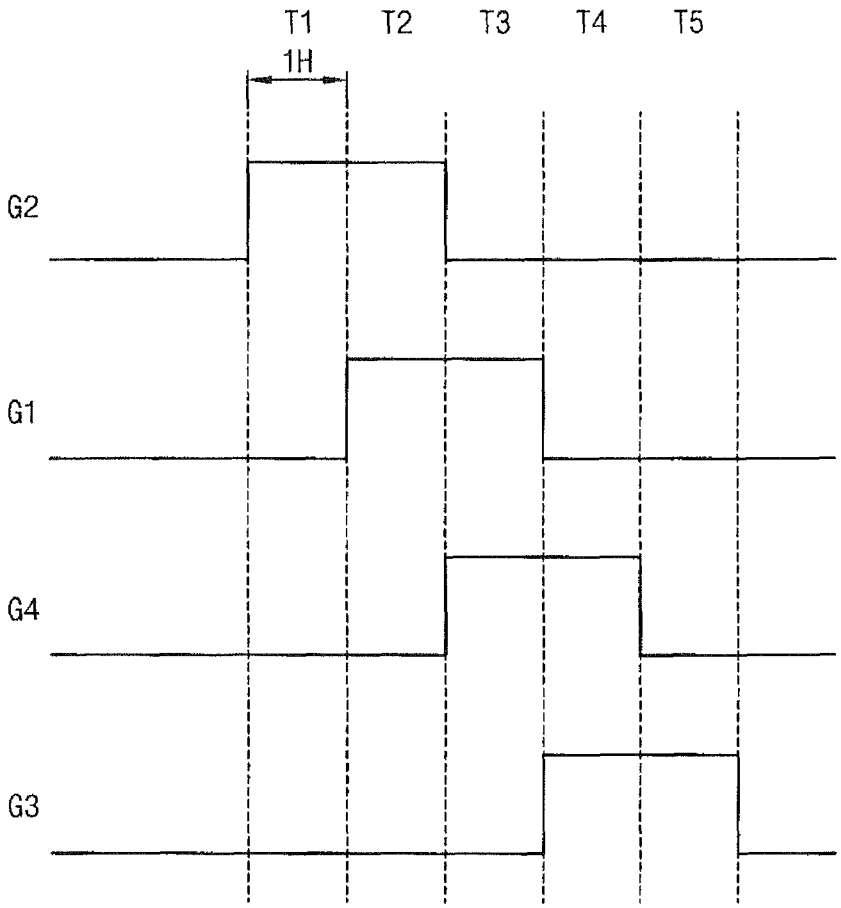
FIG. 3 is a timing diagram showing a sequence of applying gate signals to gate lines of FIG. 1 according to a precharging driving method.

FIG. 3 is a timing diagram showing a sequence of applying gate signals to gate lines of FIG. 1 according to a precharging driving method. For simplicity of explanation, the first four gate signals G1 to G4 are explained. The gate signals G1 to G3 are sequentially applied to the gate lines GL1 to GL4 of FIG. 2. The sequence of applying gate signals is G2→G1→G4→G3. Each of gate signals includes an ON level for two horizontal periods. For a first horizontal period of the two horizontal periods, a precharge voltage is applied to a subpixel through a data line. For a second horizontal period of the two horizontal periods, a charging voltage is applied to the subpixel through the data line. As a result, the subpixel is charged for two horizontal periods by a precharge voltage and a charging voltage. A charging voltage may be interchangeably used with a data voltage.

Two adjacent gate signals of the sequence are partially overlapped. For example, in timing T2, the second horizontal period of a second gate signal G2 is overlapped with the first horizontal period of a first gate signal G1. In timing T3, the second horizontal period of the first gate signal G1 is overlapped with the first horizontal period of a fourth gate signal G4. In timing T4, the second horizontal period of the fourth gate signal G4 is overlapped with the first horizontal period of a third gate signal G3.

Hereinafter, referring to FIGS. 4 to 6, a vertical line defect will be explained as an example of a displaying defect that may occur without a compensation method according to an exemplary embodiment of the inventive concept. The vertical line defect explained here is an exemplary displaying defect, and such defect may occur in a different way depending on arrangements of the data lines, the gate lines, and the subpixels in the displaying panel 100.

Figure 4:
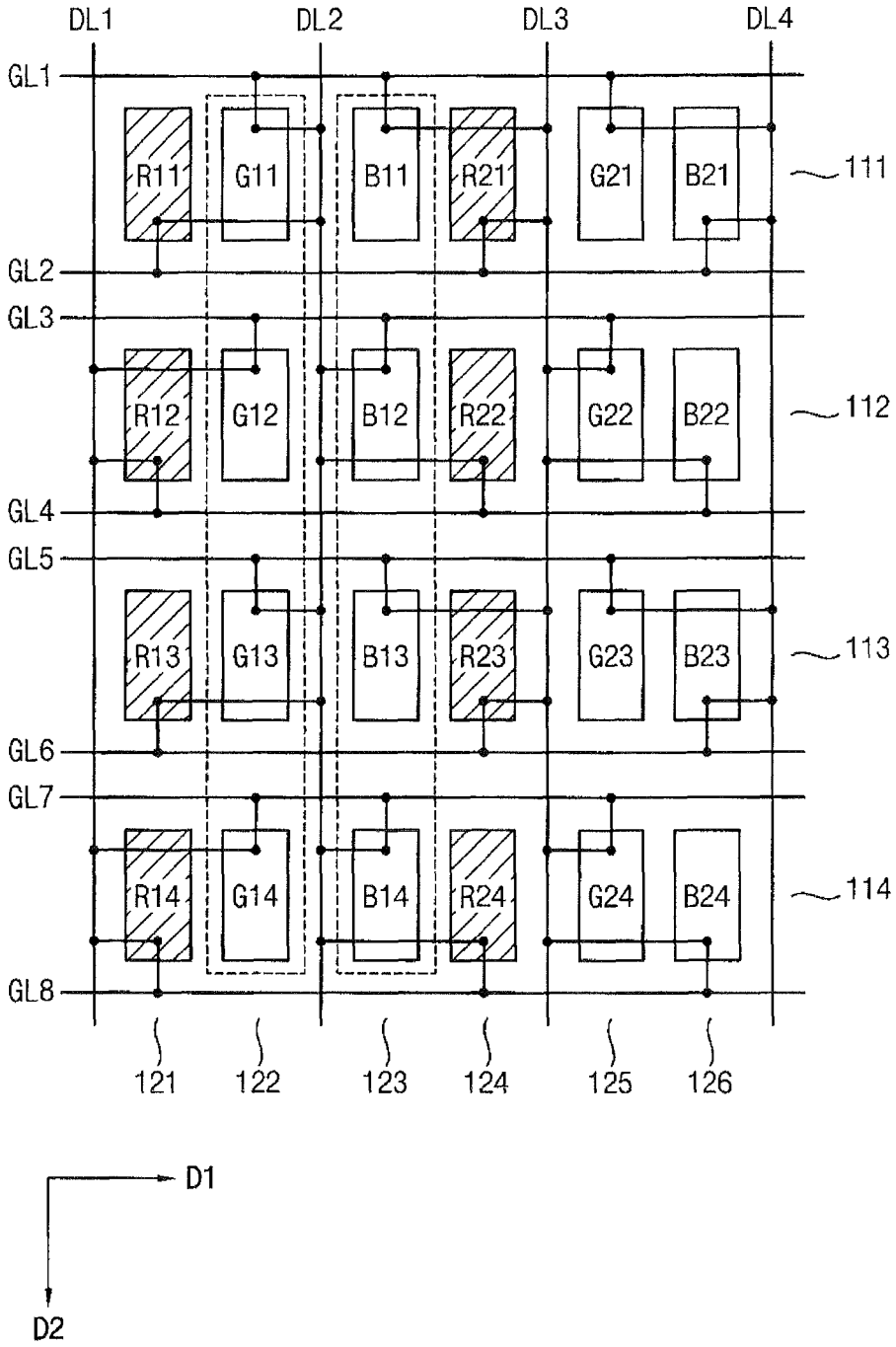
FIG. 4 shows a vertical line defect of a subpixel column including subpixels that are insufficiently precharged.

FIG. 4 shows a vertical line defect of a subpixel column including subpixels that are insufficiently precharged. The displaying panel displays a substantially cyan image according to the timing diagram of FIG. 3. A subpixel is defined as an insufficiently precharged subpixel when it is precharged with a previous subpixel data having a relatively low grayscale and is charged with a present subpixel data having a relatively high grayscale. The previous subpixel is defined as a subpixel in the second horizontal period of a gate signal, and the present subpixel is defined as a subpixel in the first horizontal period of another gate signal. The second horizontal period of the gate signal is overlapped with the first horizontal period of another gate signal. The previous subpixel and the present subpixel share a data line for such overlapped period so that the charging voltage of the previous subpixel precharges the present subpixel.

To display a substantially cyan image, the red subpixels R11 to R24 have a subpixel data having relatively low grayscales. Green and blue subpixels G11 to G24 and B11 to B24 have a subpixel data having relatively high grayscales.

The relatively low grayscale may be a minimum grayscale or a grayscale substantially close to the minimum grayscale. For example, the relatively low grayscale may be a grayscale corresponding to substantially a black grayscale in a normal black mode. The relatively high grayscale may be a maximum grayscale or a grayscale substantially close to the maximum grayscale. For example, the relatively high grayscale may be a grayscale corresponding to substantially a white grayscale in the normal black mode.

Referring to FIGS. 3 and 4, second and third subpixel columns grouped by dashed lines may constitute vertical line defects because those subpixels are precharged by a previous subpixel data having a relatively low grayscale and are charged by a present subpixel data having a relatively high grayscale, i.e., insufficiently precharged.

For timing T1, a second gate signal G2 is in the first horizontal period of the ON level and subpixels R11, R21, and B21 of a first subpixel row 110 are precharged by a precharge voltage supplied to data lines DL2, DL3, and DL4. The precharge voltage applied to the red subpixels R11 and R21 through the data line DL2 and DL3 is a relatively low voltage because the subpixels R11 and R21 receive subpixel data having a relatively low grayscale for displaying a substantially cyan image. The precharge voltage applied to the blue subpixel B21 through the data line DL4 is a relatively high voltage because the subpixel B21 receives a subpixel data having a relatively high grayscale for displaying the substantially cyan image. As explained above, the data driver 400 converts a grayscale of a subpixel data to an analog signal having a data voltage corresponding to the grayscale. Therefore, a relatively high grayscale corresponds to a relatively high voltage, and a relatively low grayscale corresponds to a relatively low voltage.

For the subsequent timing T2, the second gate signal G2 is partially overlapped with a first gate signal G1. The second gate signal G2 is in the second horizontal period of its ON level, and the first gate signal G1 is in the first horizontal period of its ON level. As a result, a charging operation occurs simultaneously with a precharging operation at timing T2. For example, the subpixels R11, R21 and B21 of the first subpixel row 110 that are precharged in the timing T1 are charged with a charging voltage based on the subpixel data for the second horizontal period of the second gate signal G2. The subpixels R11 and R21 are charged with a relative low charging voltage because the subpixel data for the subpixels R11 and R21 includes a relatively low grayscale. The subpixel B21 is charged with a relatively high charging voltage because the subpixel data for the subpixel B21 includes a relatively high grayscale.

At the same time, the charging voltage for the subpixels R11, R21 and B21 precharges the subpixels G11, B11, and G21 that are not precharged in previous timing T1. For example, the green subpixel G11 and the blue subpixel B11 are prechareged by the relatively low charging voltage that is applied through the data lines DL2 and DL3. The relatively low charging voltage is applied to the subpixels G11 and B11 for the first horizontal period of the first gate signal G1. On the other hand, the green subpixel G21 is precharged with the relatively high charging voltage that is applied through the data line DL4. The relatively high charging voltage is applied to the green subpixel G21 for the first horizontal period of the first gate signal G1. The precharge voltage corresponds to the charging voltage previously used for the previous timing T1.

For the next timing T3, the first gate signal G1 is partially overlapped with a fourth gate signal G4. The first gate signal G1 is in the second horizontal period of its ON level, and the fourth gate signal G4 is in the first horizontal period of its ON level. As a result, a charging operation occurs simultaneously with a precharging operation at timing T3.

For example, the subpixels G11, B11 and G21 of the first subpixel row 110 that are precharged in timing T2 are charged with a charging voltage based on the subpixel data for the second horizontal period of the first gate signal G1. The subpixels G11, B11, and G21 are charged with a relatively high charging voltage because the subpixel data for the subpixels G11, B11, and G21 includes a relatively high grayscale for displaying the substantially cyan image.

At timing T3, subpixels G11 and B11 constitute the vertical line defect. In timing T3, the subpixels G11 and B11 are precharged with the relatively low charging voltage for the previous subpixels R11 and R21 that are represented by hatched boxes. Since the subpixels G11 and B11 receive a current subpixel data having a relatively high grayscale for displaying the substantially cyan image, those subpixels are charged with a relatively high charging voltage. So, the subpixels G11 and B11 are insufficiently precharged.

At the same time, subpixels R12, R22, and B22 of the second subpixel row 120 are precharged for the first horizontal period of the fourth gate signal G4. The subpixels R22 and B22 are precharged by the relatively high charging voltage that is applied to the subpixels G11 and B11 of the first subpixel row 110 through the data lines DL2 and DL3. The data line DL2 is shared by the green subpixel G11 of the first subpixel row 110 and the red subpixel R22 of the second subpixel row 120 due to the overlapped period of the gate signals G1 and G4 for timing T3. The data line DL3 is shared by the blue subpixel B11 of the first subpixel row 110 and the blue subpixel B22 of the second subpixel row 112 due to the overlapped period of the gate signals G1 and G4 for timing T3. Therefore, the charging voltage for the first subpixel row 110 precharges the subpixels R22 and B22 of the second subpixel row 112. On the other hand, the subpixel R12 is precharged by the first data line DL1 for the first horizontal period of the fourth gate signal G4. Since the subpixel data for the subpixel R12 include a relatively low grayscale for displaying a substantially cyan image, a relatively low voltage is applied to the first data line DL1 and the subpixel R12 is precharged by the relatively low voltage.

For the next timing T4, the fourth gate signal G4 is partially overlapped with a third gate signal G3. The fourth gate signal G4 is in the second horizontal period of its ON level, and the third gate signal G3 is in the first horizontal period of its ON level. As a result, a charging operation occurs simultaneously with a precharging operation at timing T4.

For example, the subpixels R12, R22 and B22 of the second subpixel row 112 that are precharged in timing T3 are charged with a charging voltage based on the subpixel data for the second horizontal period of the fourth gate signal G4. The subpixels R12 and R22 are charged with a relative low charging voltage because the subpixel data for the subpixels R12 and R22 include a relatively low grayscale for displaying the substantially cyan image. The subpixel B22 is charged with a relative high charging voltage because the subpixel data for the subpixel B22 include a relatively high grayscale for displaying the substantially cyan image.

At the same time, subpixels G12, B12, and G22 of the second subpixel row 120 are precharged for the first horizontal period of the fourth gate signal G3. The subpixels G12 and B122 are precharged by the relatively low charging voltage that is applied to the subpixels R12 and R22 of the second subpixel row 120 through the data lines DL1 and DL2. The data line DL1 is shared by the red subpixel R12 and the green subpixel G12 of the second subpixel row 112 due to the overlapped period of the gate signals G4 and G3 for timing T4. The data line DL2 is shared by the red subpixel R22 and the blue subpixel B12 of the second subpixel row 112 due to the overlapped period of the gate signals G4 and G3 for timing T4. Therefore, the charging voltage for the second subpixel row 112 precharges the subpixels G12 and B12 of the second subpixel row 112. On the other hand, the subpixel G22 is precharged by the third data line DL3 for the first horizontal period of the third gate signal G3. Since the subpixel data for the subpixel G22 includes a relatively high grayscale for displaying a substantially cyan image, a relatively high voltage is applied to the third data line DL3, and the green subpixel G22 is precharged by the relatively high voltage.

For the next timing T5, the third gate signal G3 is in the second horizontal period of its ON level and a charging operation occurs to the subpixels G12, B12, and G22. For example, the subpixels G12, B12 and G22 of the second subpixel row 112 that are precharged in timing T4 are charged with a charging voltage based on the subpixel data for the subpixels G12, B12, and G22. The subpixels G12, B12, and G22 are charged with a relative high charging voltage because the subpixel data for the subpixels G12, B12, and G22 includes a relatively high grayscale for displaying the substantially cyan image.

The subpixels G12 and B12 constitute the vertical line defect. In the previous timing T4, the subpixels G12 and B12 are precharged with the relatively low charging voltage that charged the previous subpixels R12 and R22. Since the subpixels G12 and B12 receive subpixel data having a relatively high grayscale for displaying the substantially cyan image, those subpixels G12 and B12 are charged with a relatively high charging voltage. So, the subpixels G11 and B11 are insufficiently precharged.

The gate lines GL5 to GL8 will be subsequently driven by a sequence as shown in FIG. 3 to display a substantially cyan image. For example, the gate lines will be driven as follows: GL2→GL1→GL4→GL3→GL6→GL5→GL8→GL7. The other subpixels G13, G14, B13 and B14 enclosed by the dashed box may be insufficiently precharged as explained above, so further explanation will be omitted here.

As explained above, data voltages for subpixel data applied in a data line are applied both to subpixels in a precharging operation and subpixels in a charging operation for the first horizontal period and the second horizontal period of a gate signal. In the subsequent timing period, the subpixels precharged in the previous precharging operation are charged. When the subpixels are precharged with a relatively low precharge voltage for the first horizontal period and are charged with a relatively high charging voltage for the second horizontal period, the subpixels may be insufficiently charged and may cause a displaying defect such as a vertical line defect.

For example, the first subpixel R11 and the second subpixel G11 of the first subpixel row 111 are electrically connected to the second data line DL2. A relatively high charging voltage is applied to the second subpixel G11 through the second data line DL2 for the second horizontal period of the first gate signal G1. However, the first subpixel R11 of the first subpixel row 111 is, for the previous second horizontal period of the second gate signal G2, charged with a relatively low charging voltage. The relatively low voltage of the first subpixel R11 also precharges the second subpixel G11 of the first subpixel row 110 for the first horizontal period of the first gate signal G1 which is overlapped with the second horizontal period of the second gate signal G2. So, the subpixel G11 is insufficiently precharged and constitutes a vertical defect because the subpixel G11 is insufficiently charged for the second horizontal period of the first gate signal G1.

In contrast, the fifth subpixel G21 might not suffer from such insufficient charging problem as discussed above. The fifth subpixel G21 and the sixth subpixel B21 of the first subpixel row 111 are electrically connected to the fourth data line DL4. Both subpixels G21 and B21 are charged with a relatively high voltage to display a cyan color image. As a result, the relatively high voltage precharges the fifth subpixel G21 of the first subpixel row 111 during the previous timing period and the relatively high grayscale voltage may charge sufficiently the fifth subpixel G21.

The green subpixels G11 to G14 of the second subpixel column 122 represent relatively dark color compared to the green subpixels G21 to G24 of the fifth subpixel column 125 so that a vertical line defect may be generated. In the same way, the blue subpixels B11 to B14 in the third subpixel column 123 represent relatively dark color compared to the blue subpixels B21 to B24 in the sixth subpixel column 126 so that a vertical line defect may be generated.

Figure 5:
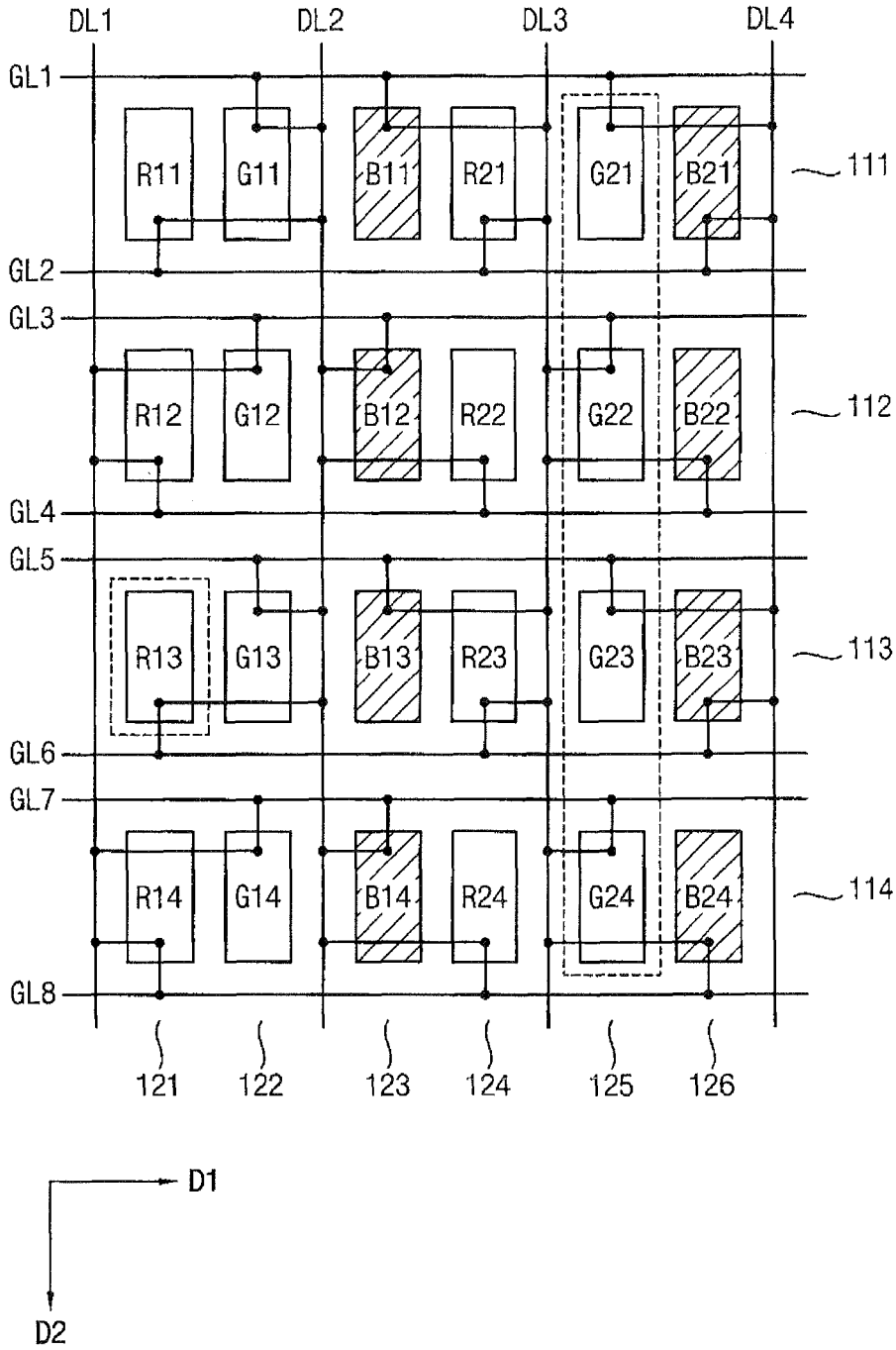
FIG. 5 shows a displaying defect of a subpixel column including subpixels that are insufficiently precharged.

FIG. 5 shows a displaying defect of a subpixel column including subpixels that are insufficiently precharged. The displaying panel displays a substantially yellow image according to the timing diagram of FIG. 3.

For displaying a substantially yellow image, the red subpixels R11 to R24 and the green subpixels G11 to G24 have a subpixel data having a relatively high grayscale. The blue subpixels B11 to B24 have a subpixel data having a relatively low grayscale.

The same sequence of driving gate signals as that of FIG. 3 applies here, so further detailed explanation will be omitted here. A subpixel is defined as insufficiently precharged subpixel when it is precharged with a previous subpixel data having a relatively low grayscale and is charged with a current subpixel data having a relatively high grayscale. As explained above referring to FIG. 4, such insufficiently precharged subpixel may constitute a displaying defect.

For a substantially yellow image, the blue subpixels B11 to B24 represented by dashed boxes receive a subpixel data having a relatively low grayscale. The blue subpixels B11 to B24 are charged with a relatively low voltage that is converted from a relatively low grayscale. When the blue subpixels B11 to B24 are charged with the relatively low voltage, subpixels R13 and G21 to G24 enclosed by a dashed line are precharged with the relatively low voltage. Those subpixels are charged with a relatively high voltage because red and green subpixels receive a relatively high grayscale to display a substantially yellow image. So the subpixels R13 and G21 to G24 enclosed by the dashed line are insufficiently precharged subpixels and may have a display defect.

For the subpixel R13 of the first subpixel column 121, the subpixel R13 is precharged when the subpixel B12 is charged with a relatively low charging voltage. The subpixel R13 and the subpixel B12 shares a data line DL2 because a gate signal G3 is in the second horizontal period and a gate signal G6 is in the first horizontal period at the same time. So the relatively low voltage for charging the subpixel B12 precharges the subpixel R13 through the data line DL2.

For the subpixels G21 to G24 of the fifth subpixel column 126, the subpixels G21 to G22 are precharged when the subpixels B21 to B24 are charged with a relatively low charging voltage. The subpixels B21 to B24 and the subpixels G21 to G24 share a data line DL4 because gate signals G2, G4, G6, and G8 are in the second horizontal period and gate signals G1, G3, G5, and G7 are in the first horizontal period, respectively. So the relatively low voltage for charging the subpixel B21 to B24 precharges the subpixels G21 to G24 through the data line DL4.

The first subpixel column 121 including the red subpixel R13 may represent relatively dark color comparing to the red subpixels the fourth subpixel column 124 so that a vertical line defect may be generated. In the same way, the fifth subpixel column 125 of the green subpixels represent relatively dark color comparing to the second subpixel column 122 so that a vertical line defect may be generated.

Figure 6:
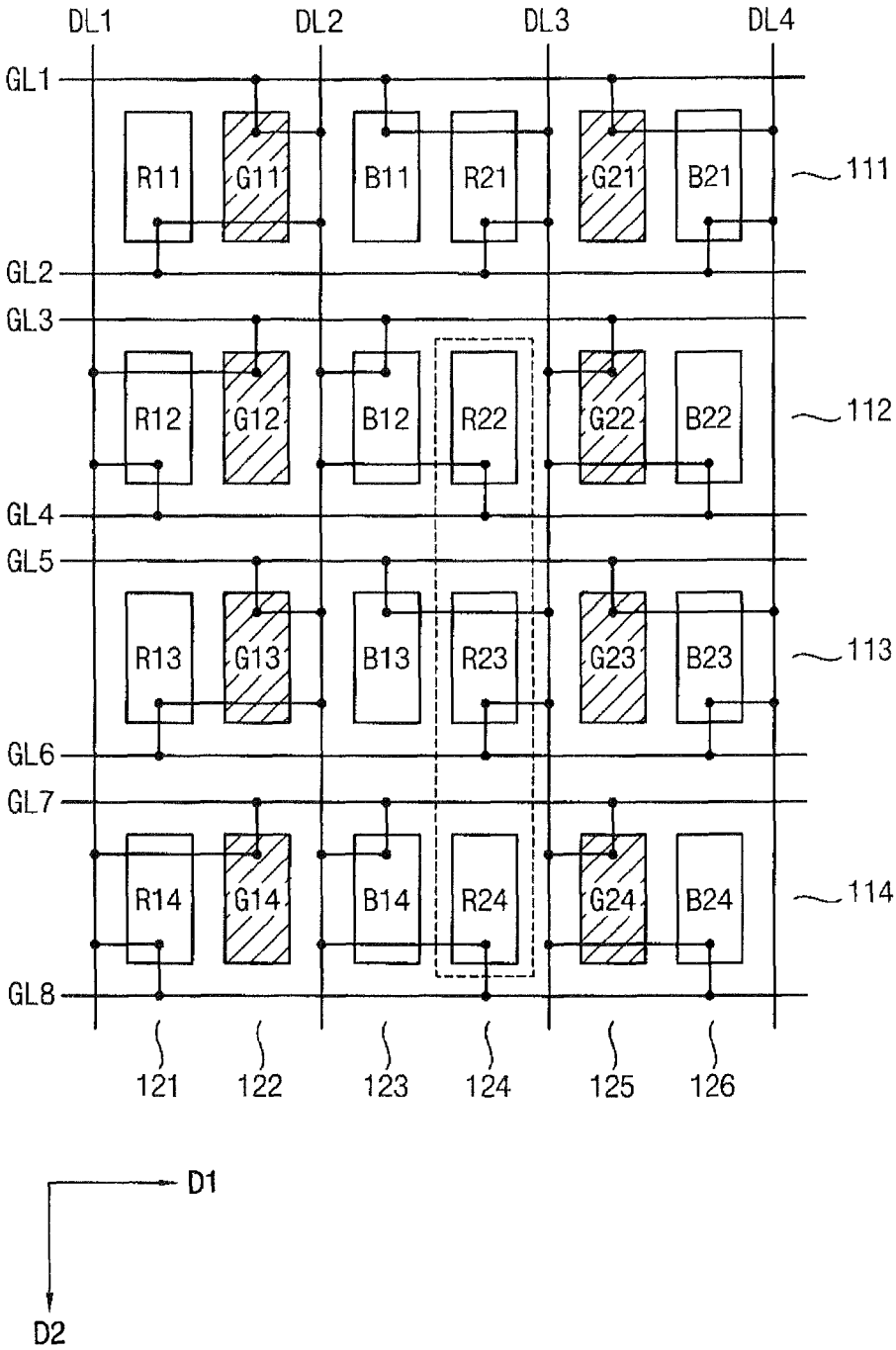
FIG. 6 shows a displaying defect of a subpixel column including subpixels that are insufficiently precharged.

FIG. 6 shows a displaying defect of a subpixel column including subpixels that are insufficiently precharged. The displaying panel displays a substantially magenta image according to the timing diagram of FIG. 3.

For displaying a substantially magenta image, the red subpixels R11 to R24 and the blue subpixels B11 to B24 have subpixel data having a relatively high grayscale. The green subpixels G11 to G24 have subpixel data having a relatively low grayscale.

The same sequence of driving gate signals as that of FIG. 3 applies here, so further detailed explanation will be omitted. A subpixel is defined as an insufficiently precharged subpixel when it is precharged with a subpixel data having a relatively low grayscale and is charged with a different subpixel data having a relatively high grayscale. As explained above referring to FIG. 4, such insufficiently precharged subpixels may constitute a displaying defect.

For a substantially magenta image, the green subpixels G11 to G24 represented by dashed boxes receive a green subpixel data having a relatively low grayscale. The green subpixels G11 to G24 of the second and the fifth subpixel column 122 and 125 are charged with a relatively low voltage that is converted from the relatively low grayscale. When the green subpixels G11 to G24 are charged with the relatively low voltage, subpixels R22 to R24 of the fourth subpixel column 124 are precharged with the relative low voltage. Those subpixels R22 to R24 are charged with a relatively high voltage because red subpixels receive a relatively high grayscale to display a substantially yellow image. So the subpixels R22 to R24 enclosed by the dashed line are insufficiently precharged subpixels and may have a display defect.

For the subpixel R22 of the fourth column 124, the subpixel R22 is precharged when the subpixel G11 is charged with a relatively low charging voltage. The subpixel R22 and the subpixel G11 share a data line DL2 because a gate signal G1 is in the second horizontal period and a gate signal G4 is in the first horizontal period at the same time. So the relatively low voltage for charging the subpixel G11 precharges the subpixel R22 through the data line DL2. For the next timing when the gate signal G4 is in the second horizontal period, the subpixel R22 is charged with a relatively high charging voltage through the data line DL2. As a result, the subpixel R22 is an insufficiently precharged subpixel and constitutes a display defect.

For the subpixels R23 of the fourth column 124, the subpixel R23 is precharged when the subpixel G22 is charged with a relatively low charging voltage. The subpixel R23 and the subpixel G22 share a data line DL3 because a gate signal G3 is in the second horizontal period and a gate signal G6 is in the first horizontal period at the same time. So the relatively low voltage for charging the subpixel G22 precharges the subpixel R23 through the data line DL2. For the next timing when the gate signal G6 is in the second horizontal period, the subpixel R23 is charged with a relatively high charging voltage through the data line DL3. As a result, the subpixel R23 is an insufficiently precharged subpixel and constitutes a display defect.

For the subpixel R24 of the fourth column 124, the subpixel R24 is precharged when the subpixel G13 is charged with a relatively low charging voltage. The subpixel R24 and the subpixel G13 share a data line DL2 because a gate signal G5 is in the second horizontal period and a gate signal G8 is in the first horizontal period at the same time. So the relatively low voltage for charging the subpixel G13 precharges the subpixel R24 through the data line DL2. For the next timing when the gate signal G8 is in the second horizontal period, the subpixel R24 is charged with a relatively high charging voltage through the data line DL2. As a result, the subpixel R24 is an insufficiently precharged subpixel and constitutes a display defect.

The red subpixels R22 to R24 of the fourth subpixel column 124 represent relatively dark color comparing to the red subpixels R11 to R14 of the first subpixel column 121 so that a vertical line defect may be generated.

FIG. 7 is a block diagram of the timing controller 200 of FIG. 1 according to an exemplary embodiment of the inventive concept. The timing controller 200 includes a grayscale compensating part 210 and a signal generating part 220 to prevent the display defect as explained above.

The grayscale data compensating part 210 receives sequentially a subpixel data RGB for subpixels. The subpixel data RGB includes a grayscale digital information representing intensity. The grayscale compensating part 210 converts a subpixel data RGB into a compensated subpixel data DATA according to a method as will be explained in FIGS. 10-12.

The grayscale compensating part 210 compensates a grayscale of a present subpixel data using a grayscale of the previous subpixel and the grayscale of the present subpixel. The previous subpixel data and the present subpixel data are applied to two subpixels that are electrically connected to the same data line. For example, in FIG. 4, the subpixel R11 is a previous subpixel and the subpixel G11 is a present subpixel. Those two subpixels R11 and G11 are electrically connected to the data line DL2 when the second horizontal period of the gate signal G2 is overlapped with the first horizontal period of the gate signal G1. In FIG. 5, the subpixels B12 is s previous subpixel and the subpixel R13 is a present subpixel. Those two subpixels B12 and R13 are electrically connected to the data line DL2 when the second horizontal period of the gate signal G3 is overlapped with the first horizontal period of the gate signal G6. In FIG. 6, the subpixel G22 is s previous subpixel and the subpixel R23 is a present subpixel. Those two subpixels G22 and R23 are electrically connected to the data line DL3 when the second horizontal period of the gate signal G3 is overlapped with the first horizontal period of the gate signal G6.

The timing controller 200 may include a single-line memory 230 that stores a subpixel data corresponding to a single subpixel row. For example, a first subpixel row 111 may be stored when the timing controller receives a second subpixel row 112. As shown in FIG. 4, a previous subpixel and a present subpixel may be included in the same subpixel row. For example, the previous subpixel R11 and the present subpixel G11 are included in the same subpixel row 111. However, a previous subpixel and a present subpixel may be included in different subpixel rows as shown in FIGS. 5 and 6. For example, in FIG. 5, the subpixel B12, a previous subpixel, is included in a second subpixel row 112. The subpixel R13, a present subpixel, is included in a third subpixel row 113. To implement a method as will be explained in FIGS. 10 to 12, the timing controller 200 may need a subpixel data that is included in a subpixel row different from a current subpixel row whose subpixel data the timing controller is currently receiving. The single-line memory 230 stores a previous subpixel data and provides the previous subpixel data when the timing controller 200 compensates a grayscale of a current subpixel.

According to an exemplary embodiment, the single-line memory may be incorporated in the grayscale compensating part 210.

According to an exemplary embodiment, the grayscale compensating part 210 may be disposed in the timing controller 200. Alternatively, the grayscale data compensating part 210 may be disposed out of the timing controller 200.

Figure 10:
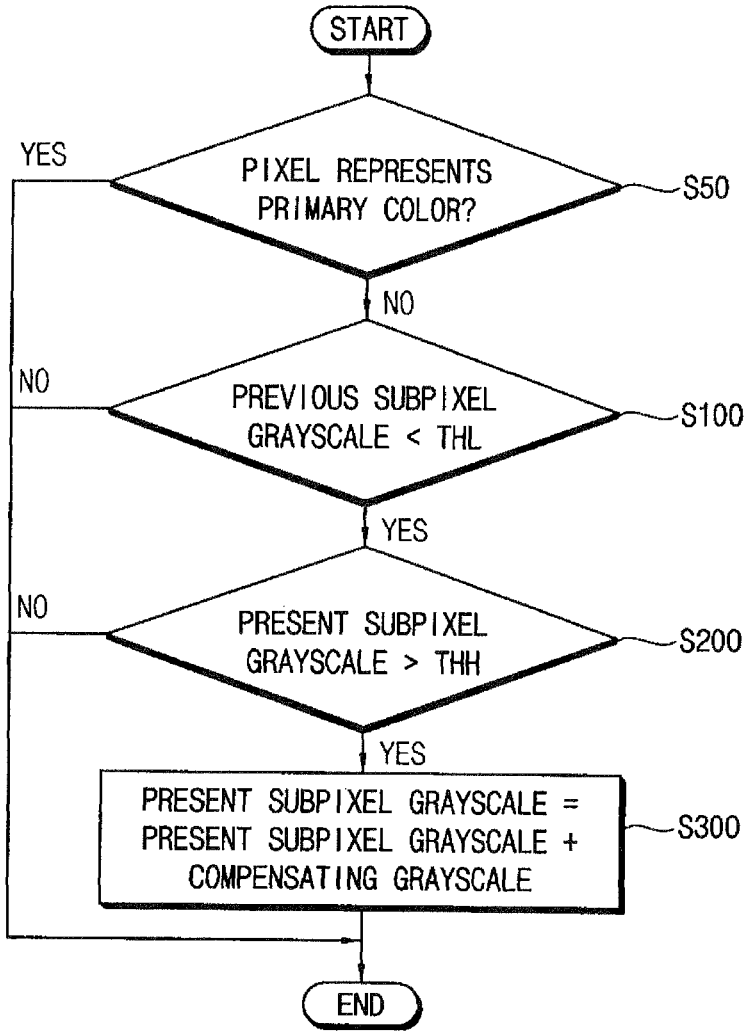
FIGS. 10 to 12 are a flow chart of a method of compensating a grayscale of a present subpixel data according to an exemplary embodiment of the inventive concept.
Figure 11:
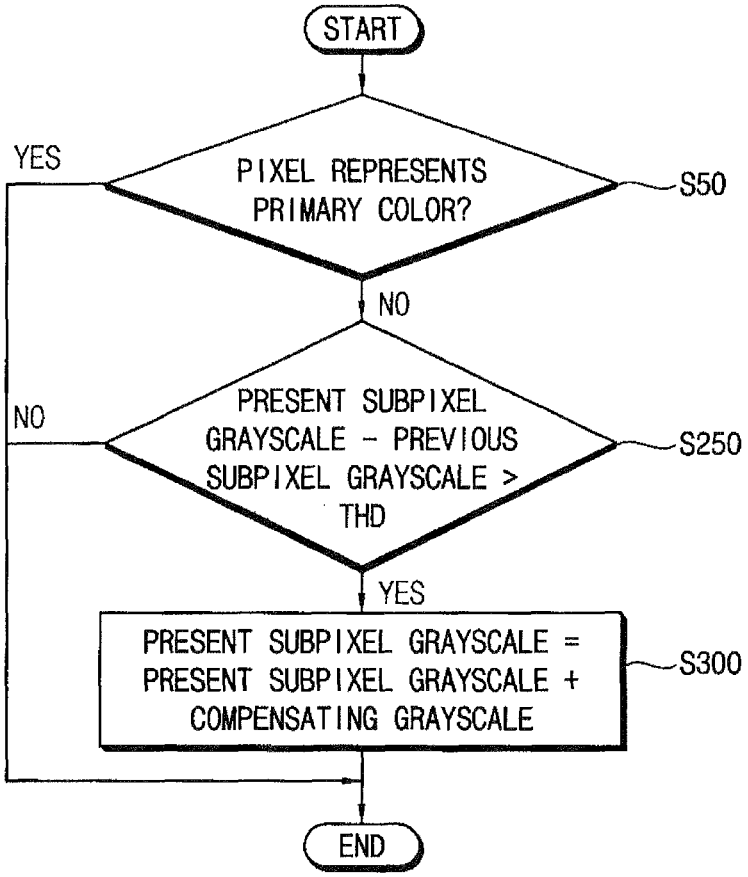
Figure 12:
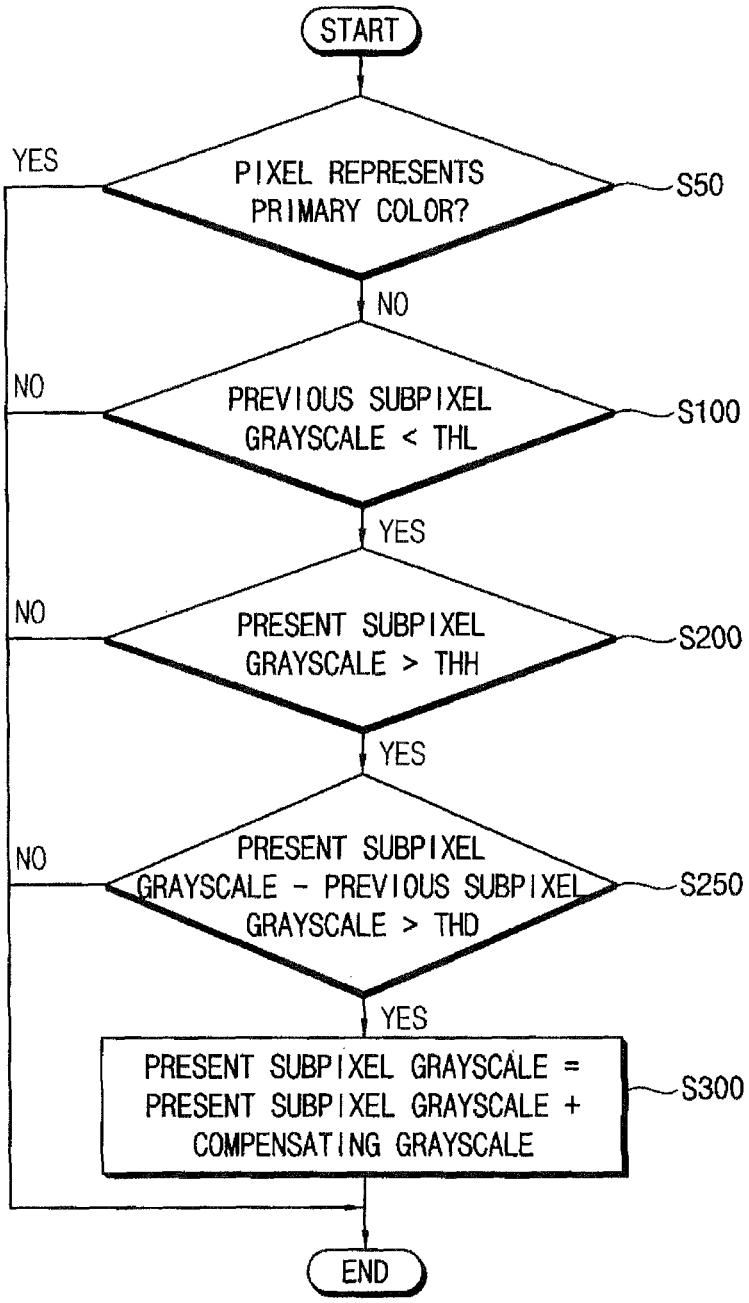

Hereinafter, FIGS. 10 to 12 are a flow chart of a method of compensating a grayscale of a present subpixel data according to an exemplary embodiment of the inventive concept. The steps S100 to S300 will be first explained and the step S50 will be explained later.

In referring to FIG. 10, in step S100, the grayscale compensating part 210 determines whether a grayscale of a previous subpixel data is less than a first threshold grayscale THL. The grayscale represent an intensity of a subpixel data. The first threshold grayscale THL may have a value corresponding to a relatively low grayscale that is less than a middle grayscale. For example, the first threshold grayscale THL may be close to a minimum grayscale. For example, the first threshold grayscale THL may be a grayscale corresponding to a substantially black grayscale of the normal black mode. The first threshold grayscale THL may be set by a user.

If a subpixel grayscale of a previous subpixel data is less than the first threshold grayscale THL then the grayscale compensating part 210 proceeds to step S200, else the grayscale compensating part 210 does not compensate a present subpixel data.

In step S200, the grayscale compensating part 210 determines whether a grayscale of the present subpixel data is greater than a second threshold grayscale THH. The second threshold grayscale THH may have a value corresponding to a relatively high grayscale that is greater than the middle grayscale. For example, the second threshold grayscale THH may be close to a maximum grayscale. For example, the second threshold grayscale THH may be a grayscale corresponding to a substantially white grayscale in the normal black mode. The second threshold grayscale THH may be set by a user.

If the grayscale of the present subpixel is greater than the second threshold grayscale THH, then the grayscale compensating part 210 proceeds to step S300, else the grayscale compensating part 210 does not compensate the present subpixel data.

In step S300, the grayscale compensating part 210 adds a compensating grayscale to the present subpixel data and generates a compensated grayscale of the present subpixel data.

The compensating grayscale of step 300 may be determined according to a difference between the grayscale of the present subpixel data and the grayscale of the previous subpixel data. For example, the grayscale compensation part may use a converting function and calculate the compensation grayscale based on the converting function of the grayscale of the present subpixel data and the grayscale of the previous subpixel data. Alternatively, the grayscale compensation part may determine the compensating grayscale by looking to a lookup table that stores the compensating grayscale based on a difference between the grayscale of the present subpixel data and the grayscale of the previous subpixel data.

The grayscale compensating part 210 may output the compensated subpixel data DATA including a compensation grayscale based on the previous subpixel grayscale and the present subpixel grayscale to the data driver 500. If the steps S100 and/or S200 do not satisfy the condition, the grayscale compensation part 210 outputs a compensated subpixel data DATA without a compensation grayscale to the data driver 500.

The signal generating part 220 receives the input control signal CONT. The signal generating part 220 generates the first control signal CONT1 to control a driving timing of the gate driver 300 based on the input control signal CONT. The signal generating part 220 generates the second control signal CONT2 to control a driving timing of the data driver 500 based on the input control signal CONT.

The signal generating part 220 outputs the first control signal CONT1 to the gate driver 300. The signal generating part 220 outputs the second control signal CONT2 to the data driver 500.

The timing controller 200 may further include an adaptive color correcting part (not shown) and a dynamic capacitance compensating part (not shown).

The adaptive color correcting part receives a subpixel data, and operates an adaptive color correction ("ACC"). The adaptive color correcting part may compensate a grayscale of the subpixel data using a gamma curve.

The dynamic capacitance compensating part operates a dynamic capacitance compensation ("DCC"), which compensates grayscale subpixel data of present frame using the previous frame data and the present frame data.

The adaptive color correcting part and the dynamic capacitance compensating part may output a corrected and/or compensated grayscale data to the grayscale data compensating part 210. Alternatively, the adaptive color correcting part and the dynamic capacitance compensating part may receive compensated grayscale data from the grayscale data compensating part 210

According to an exemplary embodiment of the inventive concept, a present subpixel may be compensated using a grayscale of the previous subpixel data and a grayscale of the present subpixel data so that a vertical line defect may be prevented. Thus, a display quality of the display panel 100 may be increased.

According to an exemplary embodiment of the inventive concept, a method of compensating grayscale of a subpixel data will be explained with reference to FIG. 11. The steps S100 to S300 will be first explained and the step S50 will be explained later.

In step S250, the grayscale compensating part 210 determines whether a difference between a grayscale of a present subpixel data and a grayscale of the previous subpixel is greater than a third threshold grayscale THD. The third threshold grayscale THD may be set to a predetermined grayscale difference that might cause a defect. When a difference between the grayscale of the present subpixel data and the grayscale of the previous subpixel is greater than the third threshold grayscale THD, the present subpixel data may be insufficiently charged because the subpixel is precharged with a relatively low grayscale of the previous subpixel data. The third threshold grayscale THD may be set by a user.

If the difference between the present subpixel grayscale and the previous subpixel grayscale is greater than the third threshold grayscale THD, then the grayscale data compensating part 210 proceeds to step S300. In step S300, the grayscale compensating part 210 adds a compensating grayscale to the present grayscale to generate a compensated present subpixel data.

According to an exemplary embodiment, the present subpixel data are compensated using the previous subpixel data and the present subpixel data so that the vertical line defect may be prevented. Thus, a display quality of the display panel 100 may be increased.

According to an exemplary embodiment of the inventive concept, a method of compensating a grayscale of a present subpixel will be explained referring to FIG. 12. The steps S100 to S300 will be first explained and the step S50 will be explained later. This method is a hybrid algorithm of those of FIGS. 10 and 11. For example, after the steps S100 and S200 of FIG. 10 are performed, the step S250 is further performed. The same principle explained above with reference to FIGS. 10 and 11 applies, so for brevity of explanation, further descriptions of each step will be omitted here.

According to an exemplary embodiment, a grayscale of the present subpixel data are compensated using a grayscale of the previous subpixel and the grayscale of the present subpixel so that the vertical line defect may be prevented. Thus, a displaying quality of the display panel 100 may be increased.

Hereinafter, step S50 of FIGS. 10 to 12 will be explained. Step S50 is a gatekeeper step to determine whether the timing controller 200 applies the compensation method explained above referring to FIGS. 10 to 12. When a display panel 100 displays a substantially primary color such as red, green, and blue, a vertical line defect might not appear on the display panel 100 without the subpixels being compensated.

Figure 9:
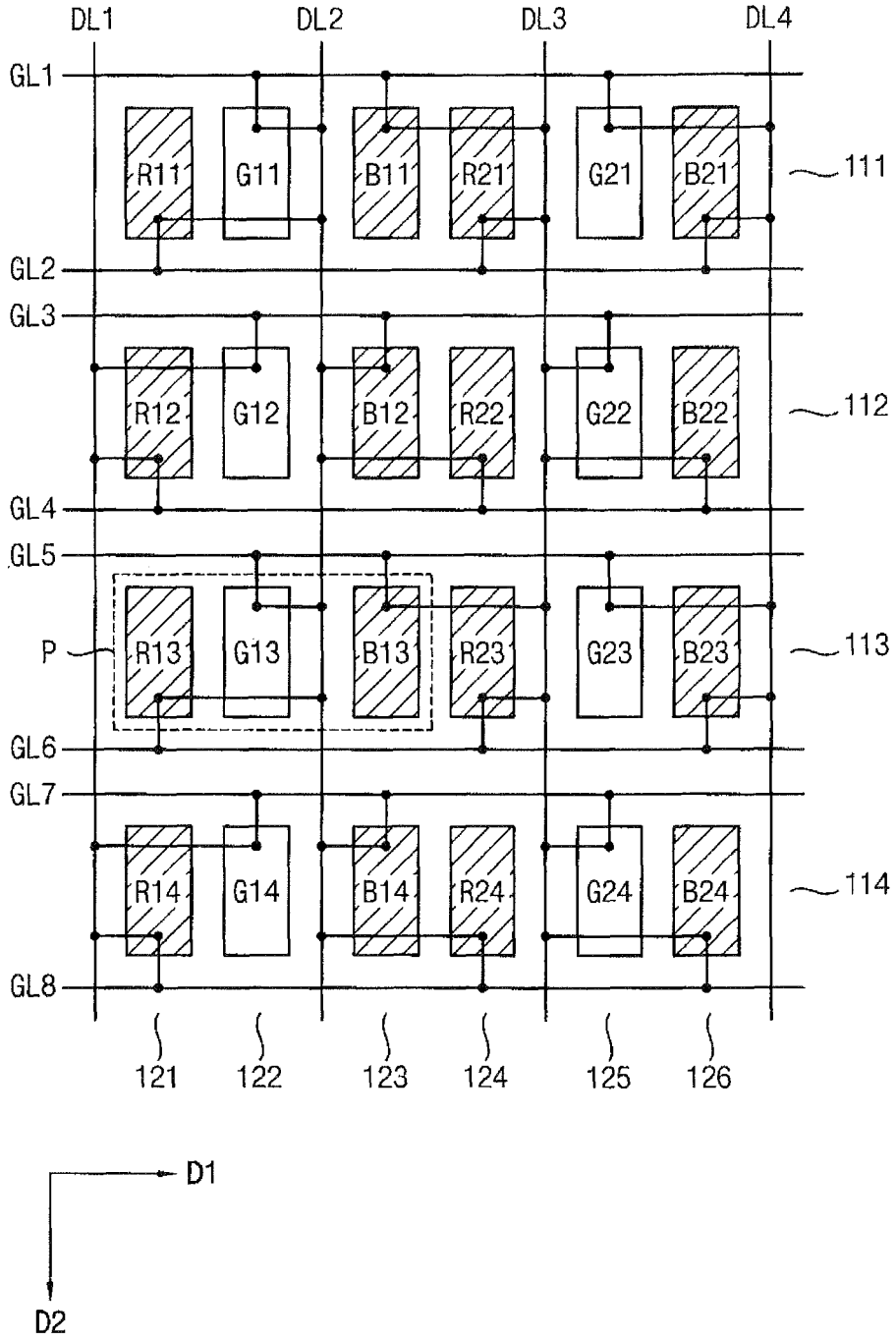
FIG. 9 shows a display panel 100 displaying a primary color of a substantially green image.

FIG. 9 shows a display panel 100 displaying a primary color of a substantially green image. For displaying a substantially green image, green subpixels G11 to G24 receive a green subpixel data having a relatively high grayscale. Red subpixels R11 to R24 receive a red subpixel data having a relatively low grayscale. Blue subpixels B11 to B24 receive a blue subpixel data having a relatively low grayscale. Dashed subpixels indicate to subpixels that receive a relatively low charging voltage. White subpixels indicate to subpixels that receive a relatively high charging voltage.

For the arrangement of the gate lines, the data lines, and subpixels as shown in FIG. 9, a vertical line defect might not appear when the display panel displays a primary color. Without the gatekeeper step S50, the timing controller 200 may compensate the green subpixels G11 to G24 with a compensation grayscale because the green subpixels G11 to G24 are insufficiently precharged subpixels—i.e., precharged with a relatively low voltage that charges the previous subpixels of red subpixels or blue subpixels and charged with a relatively high voltage.

For example, while the previous subpixels R11 to R14 are charged with a relatively low voltage, the present subpixels G11 to G14 is precharged with the relatively low voltage. Then, the present subpixels G11 to G14 is charged with a relative high voltage. Due to the relatively low precharge voltage, the present subpixels G11 to G14 of the second subpixel column 122 might be insufficiently charged. However, such vertical line defect is prevented by adding a compensating grayscale to the present subpixels G11 to G14 as explained above referring to FIGS. 7 and 10 to 12.

However, when a compensating grayscale is added to all of the green subpixels, a desirable image might not be displayed because a grayscale is represented by a limited number of bits. For displaying a substantially green image, a grayscale of the red subpixels are substantially zero, a grayscale of the blue subpixels are also substantially zero, and a grayscale of the green subpixels gradually increases as subpixel rows are sequentially displayed in the display panel 100 so that a green subpixel may have a grayscale of a breakpoint of luminance due to a compensating grayscale. For example, when the compensating grayscale is applied all of the grayscales of the green subpixel, some of the subpixels may display the same grayscale in spite of the different subpixel grayscale data because of a limited number of bits of the grayscale data. Thus, in the green image having gradually increasing grayscales, the breakpoint of luminance may be shown to a viewer.

Such undesirable effect arising from a compensating grayscale may also occur when a substantially red image or a substantially blue image is displayed.

Hereafter, the omitted step S50 of FIGS. 10 to 12 will be explained. The step S50 is to prevent the undesirable effect that may occur when the display panel 100 display a primary color Referring to FIGS. 7, 9 and 10, the additional step S50 is performed prior to performing steps S100 to S300. In step S50, the grayscale compensating part 210 determines whether a pixel represents a primary color. When the pixel represents the primary color, subpixels in the pixel need not be compensated. If the pixel representing the primary color is compensated, the undesirable effect such as the breakpoint of luminance may be generated. For example, a first pixel P of a third subpixel row 113 displays a primary color of green. The first pixel includes a red subpixel R13, a green subpixel G13 and a blue subpixel B13.

For example, to determine whether the pixel P represents a primary color of green, the grayscale data compensating part 210 may determine whether a grayscale of the green subpixel G13 is greater than a green high threshold grayscale, a grayscale of the red subpixel R13 is less than a red low threshold grayscale and a grayscale of the blue subpixel B13 is less than a blue low threshold grayscale. For example, the pixel P display a primary color of green when the grayscale of the green subpixel G13 is greater than the green high threshold grayscale, the grayscale of the red subpixel R13 is less than the red low threshold grayscale and the grayscale of the blue subpixel B13 is less than a blue low threshold grayscale.

In a similar method as explained above, the grayscale compensating part 210 may also determine whether the first pixel P represents a primary color of red or blue.

When the display panel 100 displays one of the primary colors, the vertical line defect explained referring to FIGS. 4 to 6 might not occur. Rather, compensation of a grayscale of the primary color may result in the breakpoint defect explained above referring to FIG. 9.

According to an exemplary embodiment, a present subpixel data may be compensated using a previous subpixel data and the present subpixel data so that a vertical line defect may be prevented. In addition, when a subpixel data represents a primary color, the subpixel data are not compensated because the subpixel data might not constitute the vertical line defect. Thus, a display quality of the display panel 100 may be increased.

While the present inventive concept has been shown and described with reference to exemplary embodiments thereof, it will be apparent to those of ordinary skill in the art that various changes in form and detail may be made therein without departing from the sprit and scope of the inventive concept.

What is claimed is:

1. A method of driving a display panel comprising:

receiving a first subpixel data for a first subpixel;

receiving a second subpixel data for a second subpixel;

applying a precharge voltage to the second subpixel based on a grayscale of the first subpixel data through a data line;

determining whether the second subpixel has a displaying defect based on the grayscale of the first subpixel data and a grayscale of the second subpixel data;

generating a compensated grayscale of the second subpixel data when the second subpixel is determined to have the displaying defect;

applying a charging voltage based on the compensated grayscale of the second subpixel data to the second subpixel through the data line; and applying a first gate signal and a second gate signal sequentially, each having an ON level for two successive horizontal periods, wherein a second horizontal period at the first gate signal is overlapped with a first horizontal of the second gate signal.

2. The method of claim 1, wherein the precharge voltage and the charging voltage are applied to the second subpixel for the first horizontal period and the second horizontal period of the second gate signal, respectively.

3. The method of claim 2, wherein the precharge voltage for the second subpixel is a charging voltage applied to the first subpixel for the second horizontal period of the first gate signal.

4. The method of claim 1, wherein the first subpixel data and the second subpixel data are included in a same subpixel row.

5. The method of claim 1, wherein the first subpixel data is included in a first subpixel row and the second subpixel data is included in a second subpixel row subsequent to the subpixel row.

6. The method of claim 5 further comprising storing a grayscale of the first subpixel data in a single-line memory.

7. The method of claim 1 further comprising determining whether a pixel including the second subpixel represents a primary color, wherein the second subpixel is not compensated when the pixel represents the primary color.

8. The method of claim 1, wherein the second subpixel is determined to have the displaying defect when a grayscale of the first subpixel data is less than a first threshold grayscale and a grayscale of the second subpixel data is greater than a second threshold grayscale.

9. The method of claim 1, wherein the second subpixel is determined to have the displaying defect when a difference between a grayscale of the first subpixel and a grayscale of the second subpixel is greater than a third threshold grayscale.

10. The method of claim 1, wherein the second subpixel is determined to have the displaying defect when a grayscale of the first subpixel data is less than a first threshold grayscale, a grayscale of the second subpixel data is greater than a second threshold grayscale, and a difference between the grayscale of the first subpixel and the grayscale of the second subpixel is greater than a third threshold grayscale.

11. The method of claim 1, wherein the compensated grayscale of the second subpixel data is represented by a sum of the grayscale of the second subpixel and a compensating grayscale.

12. The method of claim 11, wherein the compensating grayscale is determined according to a difference between the grayscale of the first subpixel data and the grayscale of the second subpixel data.

13. A display panel apparatus comprising:

a display panel including a first subpixel and a second subpixel;

a timing controller configured to receive a first subpixel data for the first subpixel and a second subpixel data for the second subpixel and configured to generate a compensated grayscale of the second subpixel data when the second subpixel is determined to have a displaying defect; and a data driver configured to apply a precharge voltage to the second subpixel and a charging voltage to the second subpixel through a data line, wherein the precharge voltage is based on a grayscale of the first subpixel data and the charging voltage is based on the compensated grayscale of the second subpixel data; and a gate driver configured to drive a first gate signal and a second signal sequentially, each having an ON level for two successive horizontal periods, wherein a second horizontal period of the first gate signal is overlapped with a first horizontal of the second gate signal.

14. The display panel apparatus of claim 13, wherein the timing controller includes a grayscale compensation part configured to determine whether the second subpixel has the displaying defect based on the grayscale of the first subpixel data and a grayscale of the second subpixel data and configured to generate the compensated grayscale of the second subpixel data when the second subpixel is determined to have the displaying defect.

15. The display panel apparatus of claim 14, wherein the timing controller is further configured to determine whether a pixel including the second subpixel represents a primary color, wherein the timing controller does not compensate the second subpixel when the pixel including the second subpixel represents the primary color.

16. The display panel apparatus of claim 13, wherein the precharge voltage and the charging voltage are applied to the second subpixel for the first horizontal period and the second horizontal period of the second gate signal, respectively.

17. The display panel apparatus of claim 16, wherein the precharge voltage for the second subpixel is a charging voltage applied to the first subpixel for the second horizontal period of the first gate signal.

18. The display panel apparatus of claim 13, wherein the first subpixel data and the second subpixel data are included in a same subpixel row.

19. The display panel apparatus of claim 13, wherein the first subpixel data is included in a first subpixel row and the second subpixel data is included in a second subpixel row subsequent to the subpixel row.

20. The display panel apparatus of claim 19 further comprising a single-line memory configured to store a grayscale of the first subpixel data.

21. The display panel apparatus of claim 13, wherein the second subpixel is determined to have the displaying defect when a grayscale of the first subpixel data is less than a first threshold grayscale and a grayscale of the second subpixel data is greater than a second threshold grayscale.

22. The display panel apparatus of claim 13, wherein the second subpixel is determined to have the displaying defect when a difference between a grayscale of the first subpixel and a grayscale of the second subpixel is greater than a third threshold grayscale.

23. The display panel apparatus of claim 13, wherein the second subpixel is determined to have the displaying defect when a grayscale of the first subpixel data is less than a first threshold grayscale, a grayscale of the second subpixel data is greater than a second threshold grayscale, and a difference between the grayscale of the first subpixel and the grayscale of the second subpixel is greater than a third threshold grayscale.

24. The display panel apparatus of claim 13, wherein the compensated grayscale of the second subpixel data is represented by a sum of the grayscale of the second subpixel and a compensating grayscale.

25. The display panel apparatus of claim 24, wherein the compensating grayscale is determined according to a difference between the grayscale of the first subpixel data and the grayscale of the second subpixel data.

* * * * *